US012791029B2

(12) United States Patent
Chang et al.

(10) Patent No.: US 12,791,029 B2
(45) Date of Patent: Nov. 10, 2026

(54) MECHANICALLY-ELECTRICALLY SEPARATED PUMP

(71) Applicant: ACCTON TECHNOLOGY CORPORATION, Hsinchu City (TW)

(72) Inventors: Ting-Jui Chang, New Taipei City (TW); Jih-Che Yeh, New Taipei City (TW); Ting-Min Chen, Hsinchu County (TW)

(73) Assignee: ACCTON TECHNOLOGY CORPORATION, Hsinchu City (TW)

( * ) Notice: Subject to any disclaimer, the term of this patent is extended or adjusted under 35 U.S.C. 154(b) by 0 days.

(21) Appl. No.: 19/322,676

(22) Filed: Sep. 9, 2025

(65) Prior Publication Data

US 2026/0104049 A1 Apr. 16, 2026

Related U.S. Application Data

(60) Provisional application No. 63/707,195, filed on Oct. 15, 2024.

(51) Int. Cl.

| | |
|---|---|
| ***F04D 13/02*** | (2006.01) |
| ***F04D 1/00*** | (2006.01) |
| ***F04D 29/42*** | (2006.01) |

(52) U.S. Cl.

CPC ..... *F04D 13/025* (2013.01); *F04D 1/00* (2013.01); *F04D 13/024* (2013.01); *F04D 29/426* (2013.01)

(58) Field of Classification Search

CPC ..... F04D 1/00; F04D 13/024; F04D 13/025; F04D 13/026; F04D 13/027; F04D 29/40; F04D 29/403; F04D 29/406; F04D 29/42; F04D 29/4206; F04D 29/4226; F04D 29/426

See application file for complete search history.

(56) References Cited

U.S. PATENT DOCUMENTS

| | | | | |
|---|---|---|---|---|
| 5,154,587 A * | 10/1992 | Mori | F04D 13/025 417/420 |
| 5,779,456 A * | 7/1998 | Bowes | F04D 13/027 417/420 |
| 8,353,687 B2 * | 1/2013 | Werson | F04D 13/0666 417/423.1 |
| 8,651,835 B2 * | 2/2014 | Kim | F04D 13/027 417/424.2 |
| 2026/0104049 A1 * | 4/2026 | Chang | F04D 13/025 |

* cited by examiner

*Primary Examiner* — Christopher R Legendre
(74) *Attorney, Agent, or Firm* — Apex Juris, pllc; Cera Oh

(57) ABSTRACT

A mechanically-electrically separated pump includes a centrifugal pump. The centrifugal pump has a central axis and has a cavity, which includes an inlet and an outlet, formed in a pump casing. An axial portion coaxial to the central axis is provided on a middle of the cavity. An impeller is rotatably sleeved on the axial portion and has a plurality of magnetic domains. A side of the pump casing along the central axis is connected to a connecting base for detachably connecting to a driver casing of an impeller driver. A stator is fixed in the driver casing. The impeller is spaced apart and located outside an end of the stator along the central axis and is driven by a driving magnetic field generated by the stator.

10 Claims, 11 Drawing Sheets

MECHANICALLY-ELECTRICALLY SEPARATED PUMP

CROSS-REFERENCE TO RELATED APPLICATIONS

This application claims benefit of U.S. provisional patent application Ser. No. 63/707,195, filed Oct. 15, 2024, which is incorporated by reference in its entirety.

BACKGROUND OF THE INVENTION

Technical Field

The present disclosure relates generally to a device for pumping water, and more particularly to a mechanically-electrically separated pump with a centrifugal pump and a driver that drives the centrifugal pump to operate, wherein the centrifugal pump and the driver are detachable from each other.

Description of Related Art

Currently, electronic devices, such as servers and network switches, require enhanced heat dissipation due to increased computing capability. In general, the heat dissipation way for the electronic devices is a fan and/or a liquid-cooling heat dissipation system. When the liquid-cooling heat dissipation system operates, a liquid pipeline thereof is connected to a centrifugal pump, and the centrifugal pump drives cooling liquid to circulate in the liquid pipeline, thereby removing the heat generated by the electronic devices.

The centrifugal pump typically includes a centrifugal pump body and a motor driving an impeller to rotate. An output shaft of the motor is connected to the impeller, so that the output shaft of the motor drives the impeller disposed inside the centrifugal pump body to rotate and generate centrifugal force, thereby pushing the cooling liquid in the centrifugal pump body outwards from the centrifugal pump body. However, the centrifugal pump body and the motor of the conventional centrifugal pump are an integrated unit. When the motor of the centrifugal pump malfunctions, the whole centrifugal pump is required to be removed from the liquid pipeline. The removal involves disconnecting connectors of the liquid pipeline and discharging the cooling liquid located within the liquid pipeline. As a result, disassembling and replacing the conventional centrifugal pump involves complicated procedures, and damage to electronic components may occur due to liquid leakage, thereby causing maintenance inconvenience and failing to meet the requirement of easily and rapidly repairing the liquid-cooling heat dissipation system.

BRIEF SUMMARY OF THE INVENTION

In view of the above, the primary objective of the present disclosure is to provide a mechanically-electrically separated pump, wherein a centrifugal pump and a n impeller driver are detachable, so that the impeller driver could be solely detached from the centrifugal pump; therefore, when the present disclosure is used in a liquid-cooling heat dissipation system, the centrifugal pump could remain at a state of connecting the liquid-cooling heat dissipation system, so that the liquid-cooling heat dissipation system could be maintained easily and rapidly.

The present disclosure provides a mechanically-electrically separated pump including a centrifugal pump and an impeller driver. The centrifugal pump has a central axis and includes a pump casing, an impeller, and a connecting base. A cavity is formed in the pump casing. An inlet and an outlet are respectively formed on the pump casing. The inlet and the outlet respectively communicate with a center of the cavity and a peripheral side of a periphery of the cavity. An axial portion is formed on a middle of the cavity. The central axis passes through a center of the axial portion. A center of the impeller has an axial hole and a periphery of the impeller has a plurality of blades. The axial hole is rotatably sleeved on the axial portion. The impeller is magnetized or induced to generate a plurality of different magnetic domains. The connecting base is connected to a side of the pump casing along the central axis.

The impeller driver includes a driver casing and a stator. A connecting portion is formed at an end of the driver casing. The connecting portion is detachably connected to the connecting base of the centrifugal pump. A stator seat is formed in the driver casing. The stator includes a plurality of stator modules. The stator modules surround the stator seat, are spaced from one another, and are engaged with the stator seat. The central axis passes through the center of the impeller and a center of an area surrounded by the stator modules. The impeller is spaced apart and located outside an end of the stator modules along the central axis, so that the impeller is driven by a magnetic field generated by the stator modules.

When the present disclosure is used, the centrifugal pump is connected to a liquid pipeline of a liquid-cooling heat dissipation system. Connectors of two ends of the liquid pipeline are respectively connected to the inlet and the outlet. Then, the stator modules of the impeller driver generate the alternating driving magnetic field to drive the impeller of the centrifugal pump. Through a centrifugal force generated by the rotation of the impeller, cooling liquid input from the inlet into the cavity is pressurized and is output from the outlet to the liquid pipeline for circulation.

With the aforementioned design, when the user needs to inspect the stator that generates the driving magnetic field, the impeller driver could be detached from the connecting base of the centrifugal pump, so that the impeller driver is separated from the connecting base for subsequent maintenance. During the aforementioned process, the centrifugal pump remains at a state of connecting to the liquid pipeline, so that the connectors of the liquid pipeline are not required to be disconnected, and the cooling liquid in the liquid pipeline is not required to be discharged. In this way, maintenance of the impeller driver could be performed easily and conveniently and damage to electronic devices due to leakage of the cooling liquid could be prevented, so that maintenance of the liquid-cooling heat dissipation system could be performed easily and rapidly.

BRIEF DESCRIPTION OF THE SEVERAL VIEWS OF THE DRAWINGS

The present disclosure would be best understood by referring to the following detailed description of some illustrative embodiments in conjunction with the accompanying drawings, in which.

DETAILED DESCRIPTION OF THE INVENTION

Figure 1:
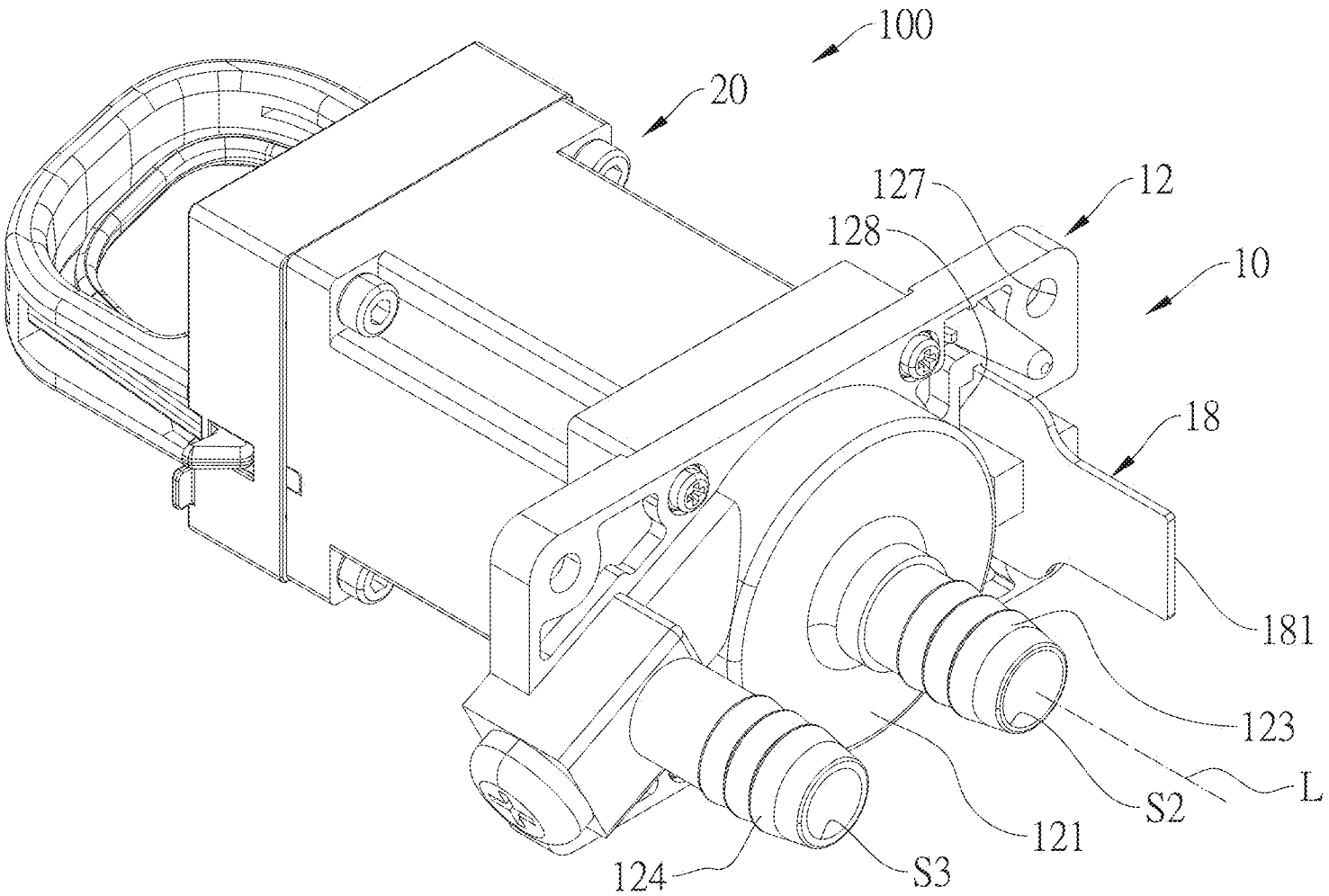
FIG. 1 is a perspective view of the mechanically-electrically separated pump according to an embodiment of the present disclosure.
Figure 2:
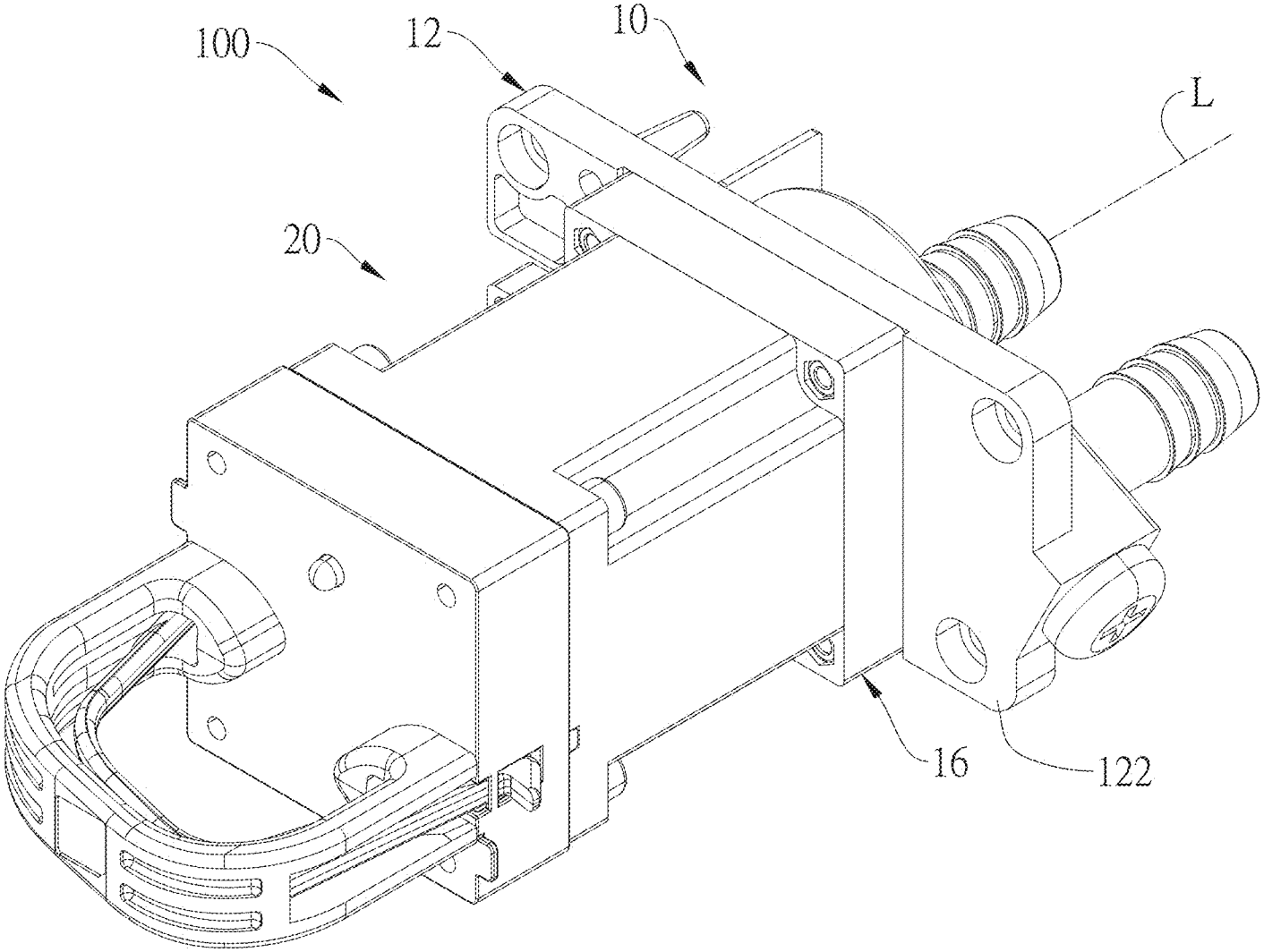
FIG. 2 is a perspective view of the mechanically-electrically separated pump according to the embodiment of the present disclosure seen from another perspective.
Figure 3:
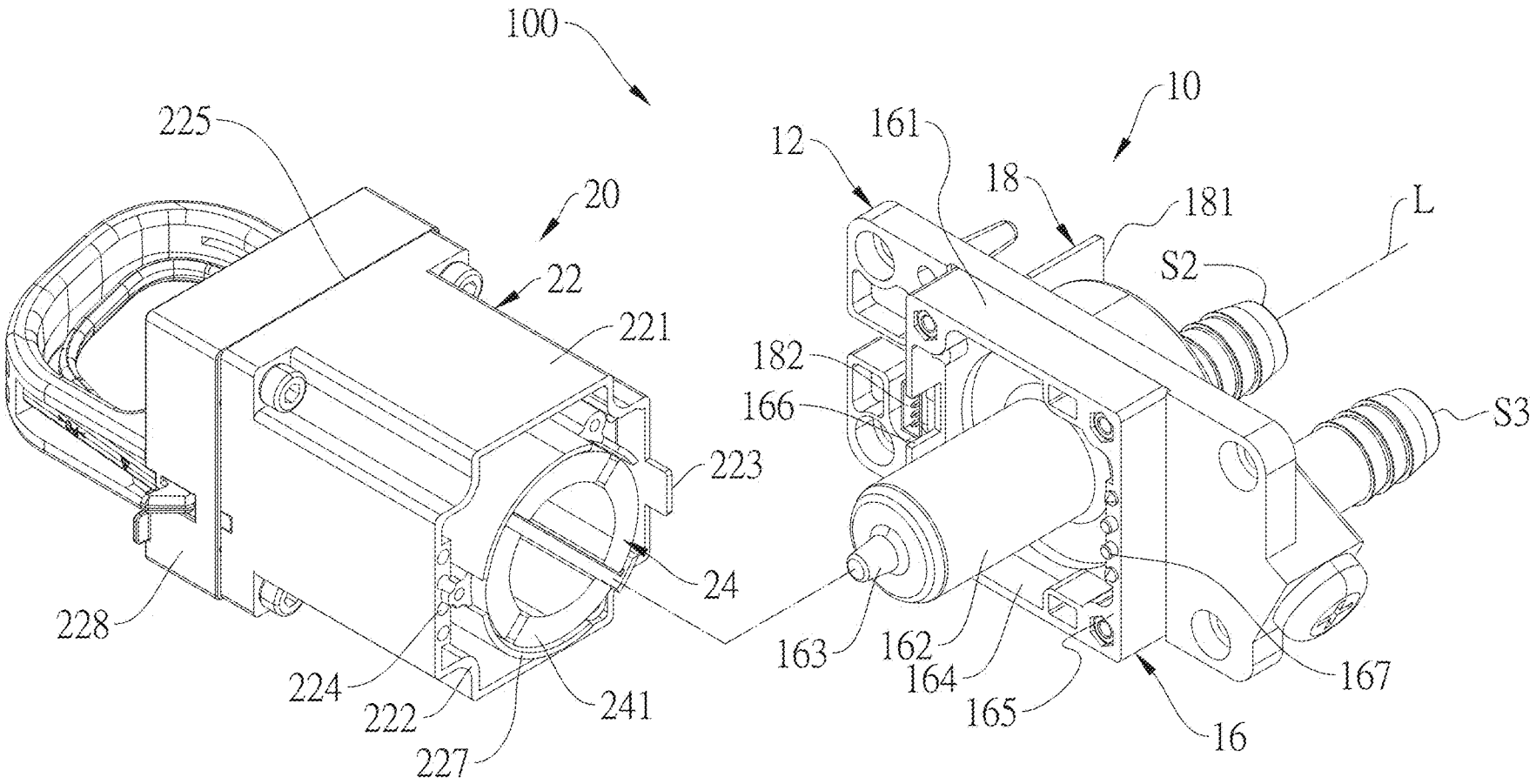
FIG. 3 is a schematic view, showing that the centrifugal pump and the impeller driver according to the embodiment of the present disclosure are separated.
Figure 3A:
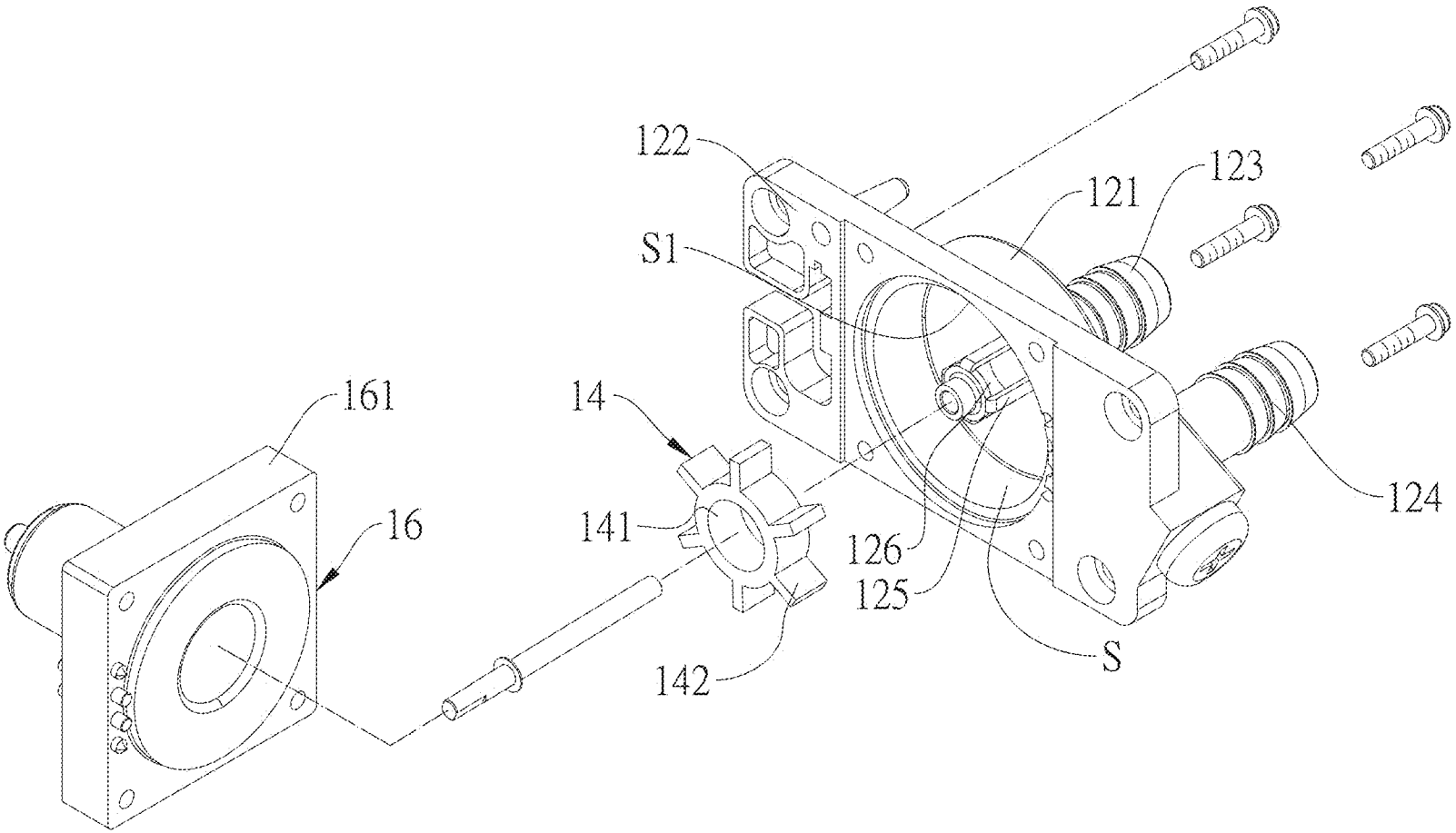
FIG. 3A is an exploded view of the centrifugal pump in FIG. 3.
Figure 4:
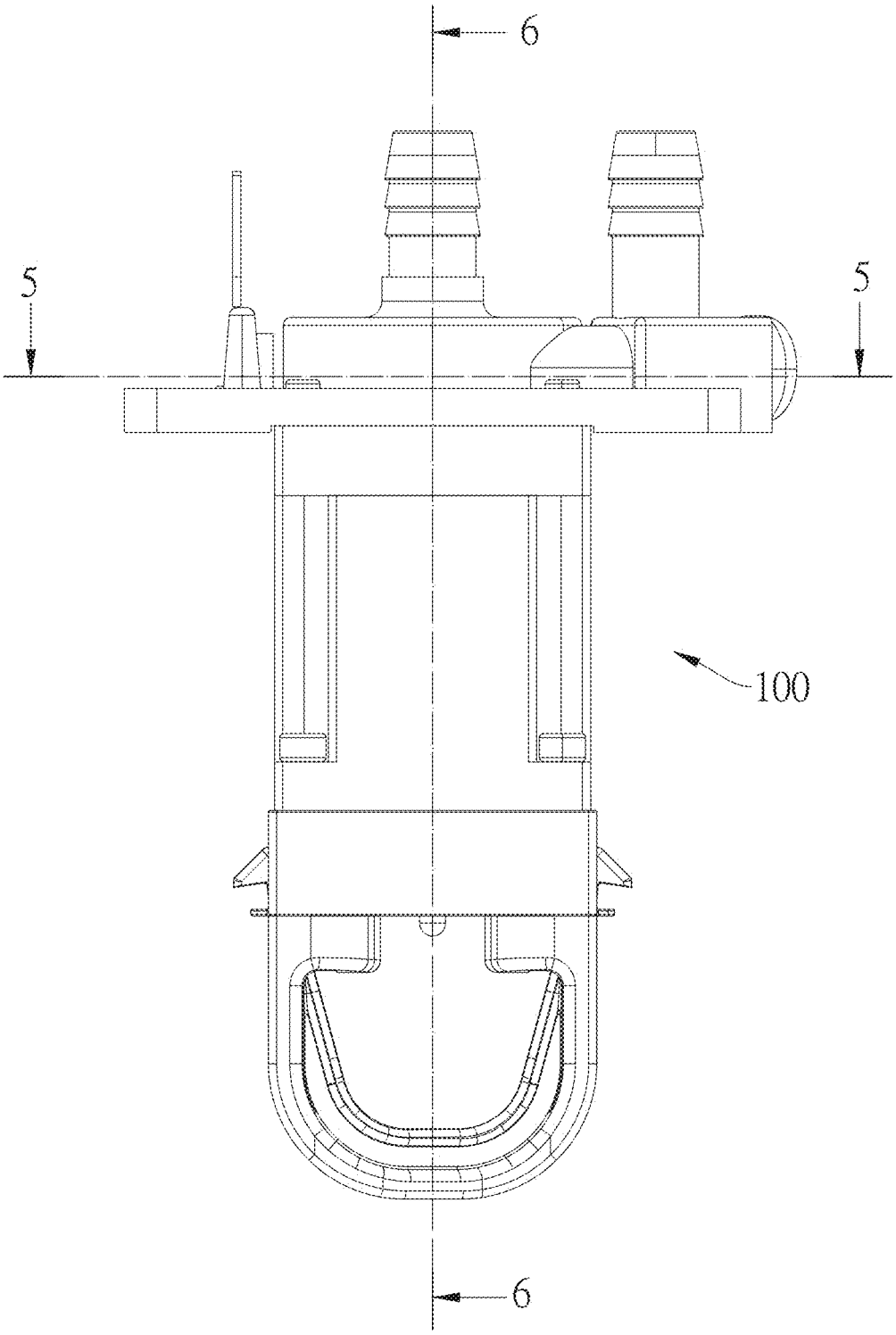
FIG. 4 is a top view of the mechanically-electrically separated pump according to the embodiment of the present disclosure.
Figure 5:
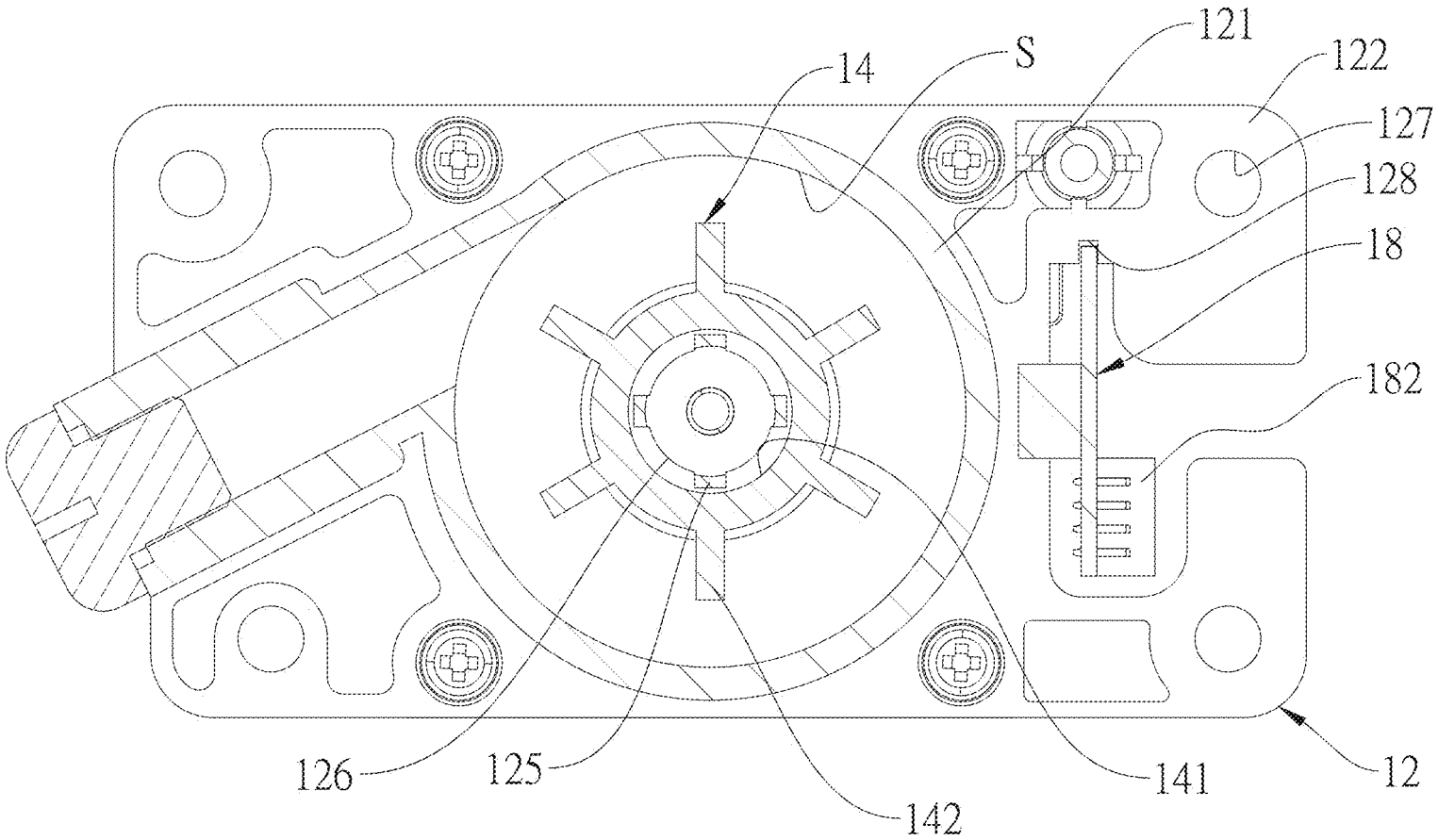
FIG. 5 is a sectional view along the 5-5 line in FIG. 4.
Figure 6:
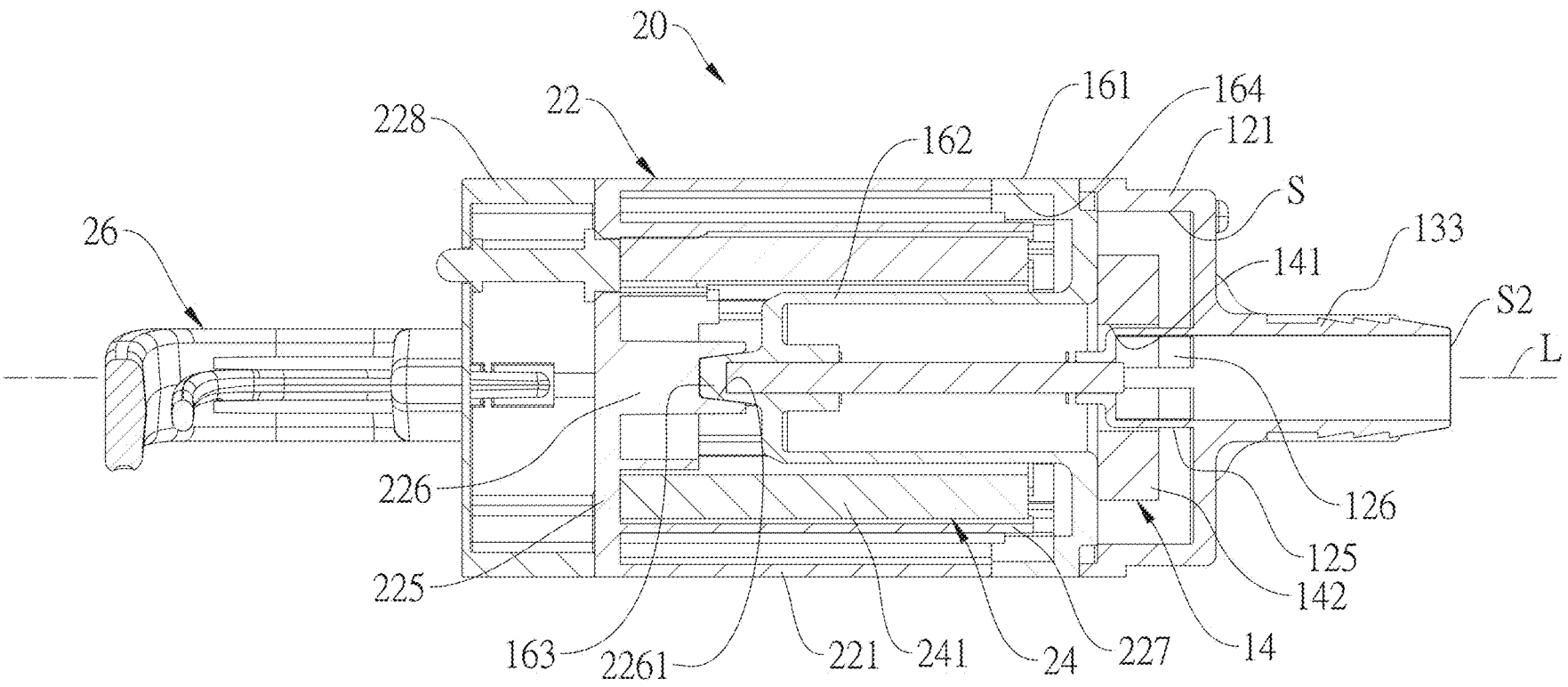
FIG. 6 is a sectional view along the 6-6 line in FIG. 4.
Figure 7:
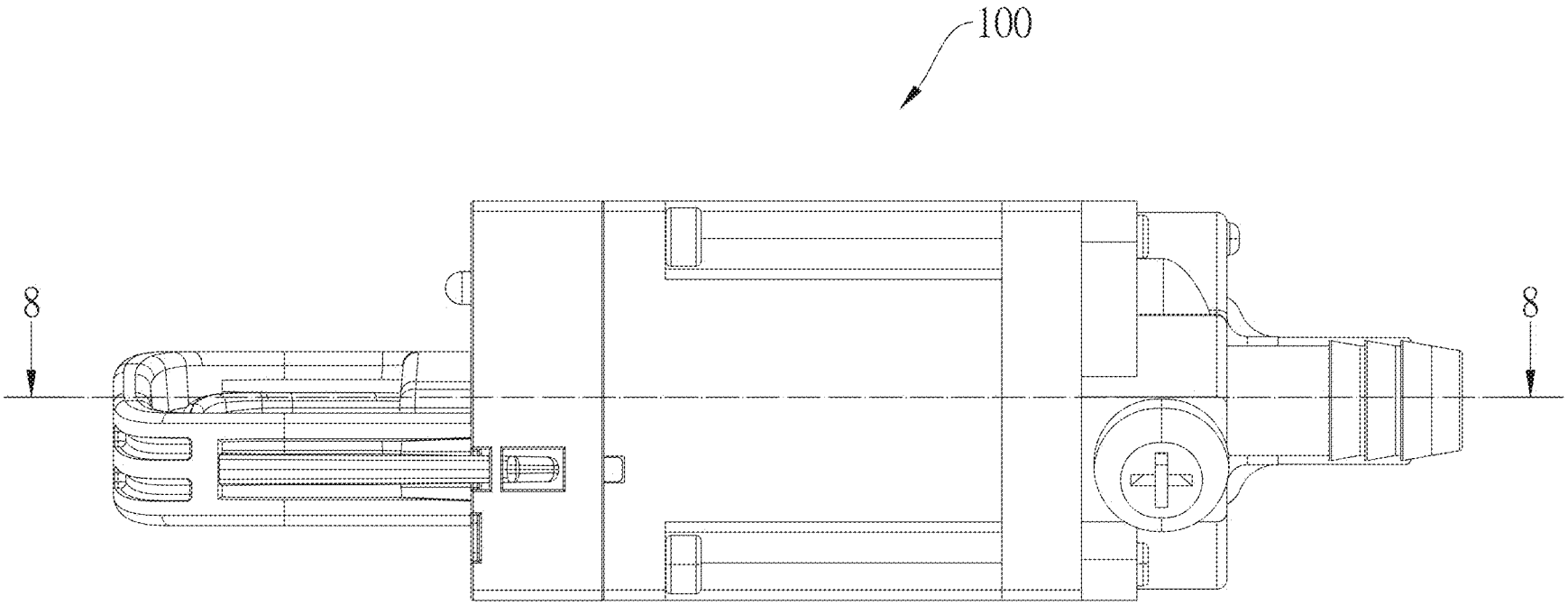
FIG. 7 is a side view of the mechanically-electrically separated pump according to the embodiment of the present disclosure seen.
Figure 8:
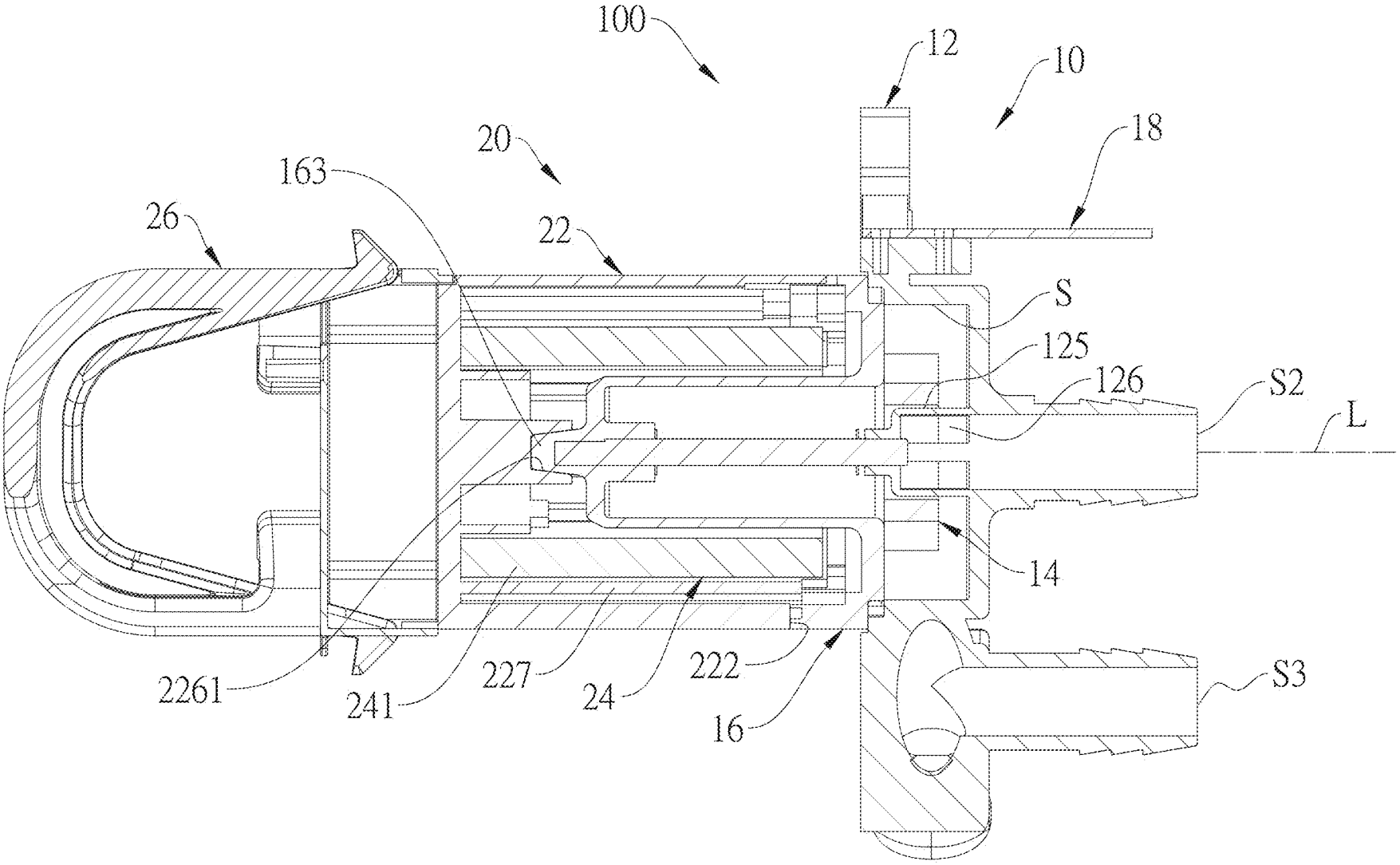
FIG. 8 is a sectional view along the 8-8 line in FIG. 7.
Figure 9:
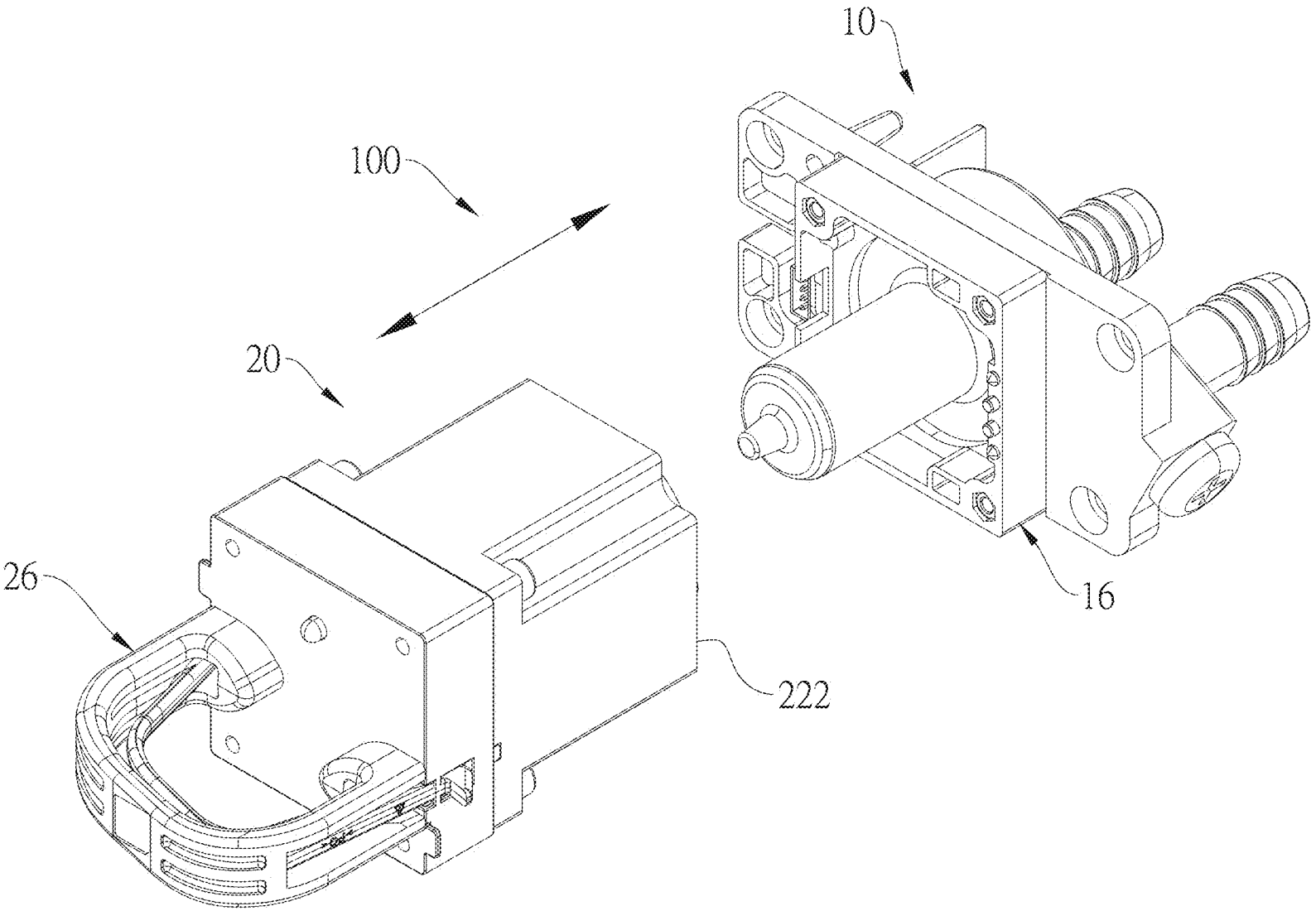
FIG. 9 is a schematic view, showing that the impeller driver in FIG. 2 is detached from the connecting base.
Figure 10:
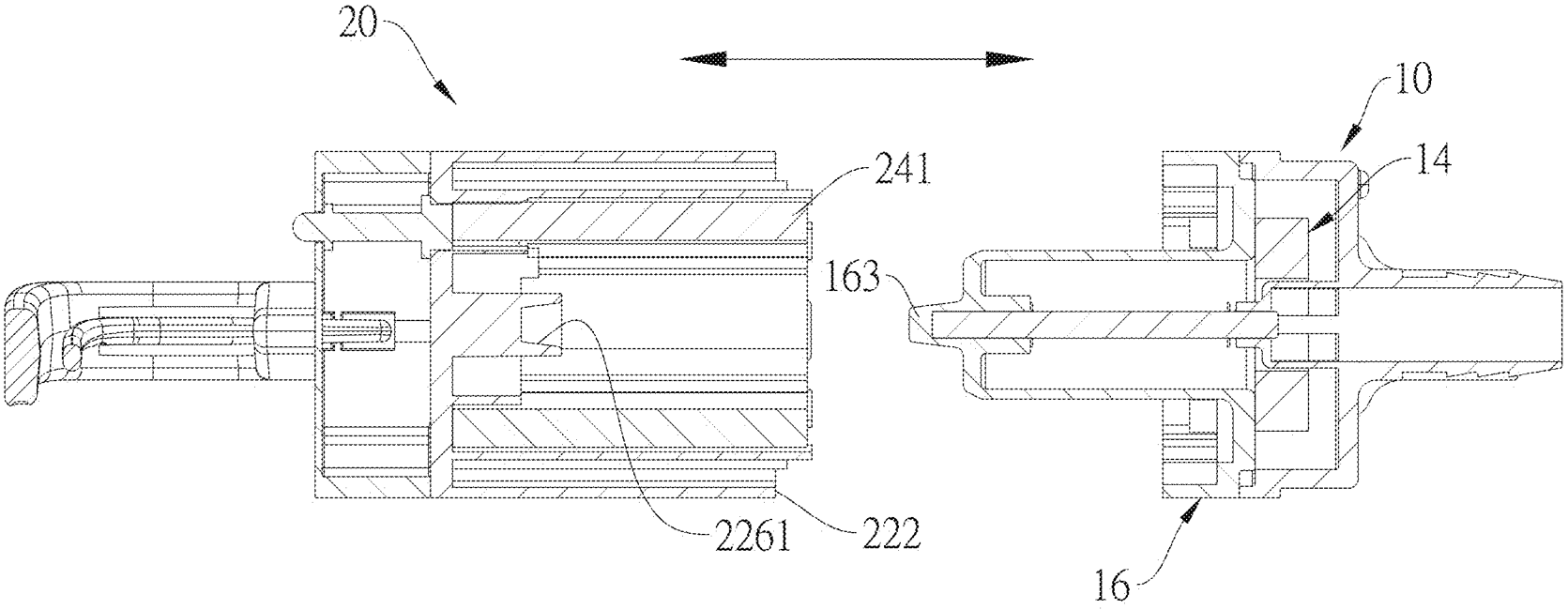
FIG. 10 is a schematic view, showing that the impeller driver in FIG. 6 is detached from the connecting base.

A mechanically-electrically separated pump 100 according to an embodiment of the present disclosure is illustrated in FIG. 1 and FIG. 2 and includes a centrifugal pump 10 and an impeller driver 20. The function of the mechanically-electrically separated pump 100 is that the centrifugal pump 10 provides the function of pressurized transfer of liquid and the impeller driver 20 and the centrifugal pump 10 are detachable from each other, so that the centrifugal pump 10 could remain at a position of being in connection to a liquid pipeline, thereby facilitating maintaining or replacing the impeller driver 20. The structure of the mechanically-electrically separated pump 100, which includes the centrifugal pump 10 and the impeller driver 20, is explained below.

Referring to FIG. 1 to FIG. 6, the centrifugal pump 10 has a central axis L and includes a pump casing 12, an impeller 14, and a connecting base 16. The pump casing 12 has a cover 121 and a plate seat 122. The cover 121 is a circular cover. A cavity S is formed inside the cover 121. An opening S1 is formed on a side of the cover 121 facing the impeller driver 20. The opening S1 communicates with the cavity S. In the current embodiment, the opening S1 is a circular hole. A center of another side of the cover 121 facing away from the impeller driver 20 is connected to an inlet pipe 123. The central axis L passes through a center of the inlet pipe 123. An inlet S2 is formed on an outer end of the inlet pipe 123. The inlet S2 communicates with a center of the cavity S. A side of a periphery of the cover 121 is connected to an outlet pipe 124. The outlet pipe 124 is parallel to the central axis L, i.e., the outlet pipe 124 is parallel to the inlet pipe 123. An outlet S3 is formed on an outer end of the outlet pipe 124. The outlet S3 communicates with a peripheral side of a the cavity S.

An axial portion 125 is formed on a middle of the cavity S. The axial portion 125 is a circular tube formed by extending from a peripheral edge of an inner end of the inlet pipe 123 toward the cavity S. The central axis L passes through a center of the axial portion 125. A plurality of hollowed holes 126 is provided around the axial portion 125. Liquid entering from the inlet S2 could pass through the hollowed holes 126 to smoothly reach the cavity S. The plate seat 122 is connected to the periphery of the cover 121 and is adjacently connected to the opening S1. In the current embodiment, the plate seat 122 is a rectangular plate and a middle portion of the plate seat 122 is connected to the periphery of the cover 121. Four corners of a periphery of the plate seat 122 respectively form a locking hole 127. A mounting groove 128 is formed on a side of the plate seat 122. A circuit board 18 is mounted in the mounting groove 128. A plurality of electronic contacts 181 is provided on an end of the circuit board 18 facing away from the impeller driver 20. A socket 182 is provided on a side of the circuit board 18 is provided.

The impeller 14 is disposed within the cavity S. A center of the impeller 14 has an axial hole 141. A periphery of the impeller 14 has a plurality of blades 142. The impeller 14 is rotatably sleeved on the axial portion 125 through the axial hole 141. The central axis L passes through the center of the impeller 14, so that the impeller 14 is rotatable around the central axis L within the cavity S. The impeller 14 could be magnetized or induced to generate a plurality of different magnetic domains, thereby facilitating the impeller 14 to be subsequently driven by a magnetic field. If the impeller 14 is magnetized to generate the different magnetic domains, the impeller 14 could be made of a ferromagnetic material. If the impeller 14 is induced to generate a magnetic field, the impeller 14 could be made of an electrically conductive material or a ferromagnetic material, or a squirrel-cage core is fitted into an annular portion of the impeller 14 located around the axial hole 141. In the current embodiment, the impeller 14 is magnetized and generates the different magnetic domains arranged around the impeller 14 and connected to one another.

The connecting base 16 is connected to a side of the pump casing 12 facing the impeller driver 20 along the central axis L. More specifically, the connecting base 16 includes a covering plate 161, an extending cylinder 162, and a guiding post 163. The covering plate 161 is a rectangular plate and is engaged with a peripheral edge of the opening S1 of the cover 121 through screwing. More specifically, the covering plate 161 is engaged with a middle portion of a side of the plate seat 122 facing the impeller driver 20 through screwing, and the covering plate 161 closes the opening S1 in a sealed manner, so that the cavity S of the pump casing 12 becomes a closed space. The extending cylinder 162 is engaged with a middle of the covering plate 161 and extends in a direction away from the pump casing 12. The extending cylinder 162 is circular and is a cylinder having a closed end facing away from the pump casing 12. The central axis L passes through a center of the extending cylinder 162.

The guiding post 163 is a conical body. The guiding post 163 is connected to a center of an end of the extending cylinder 162 facing away from the pump casing 12. An annular groove 164 is formed on a surface of the covering plate 161 facing away from the pump casing 12. The annular groove 164 surrounds the extending cylinder 162. A frame portion 165 is formed on a portion of the covering plate 161 located on an outer side of the annular groove 164. In the current embodiment, the frame portion 165 is a square wall and has a recess 166 with an opening facing the impeller driver 20. A first terminal group 167 is disposed on a side of the frame portion 165 facing the impeller driver 20. The first terminal group 167 is electrically connected to the circuit board 18.

Referring to FIG. 3 and FIG. 6 to FIG. 8, the impeller driver 20 includes a driver casing 22, a stator 24, and a handle 26. A connecting portion 222 is formed at an end of the driver casing 22 facing the connecting base 16. The connecting portion 222 is detachably connected to the connecting base 16 of the centrifugal pump 10. More specifically, the driver casing 22 has a casing portion 221. The casing portion 221 is a tubular body and the central axis L passes through a center of the casing portion 221. An end surface of an end of the casing portion 221 facing the connecting base 16 forms the connecting portion 222. The connecting portion 222 abuts against the frame portion 165 of the connecting base 16 and has a protruding sheet 223. The protruding sheet 223 is fitted into the recess 166 for positioning. Through the protruding sheet 223 fitted into the recess 166, the connecting portion 222 of the driver casing 22 could be connected to the connecting base 16 of the centrifugal pump 10 along a proper direction. A second terminal group 224 is disposed on a side of the connecting portion 222 facing the connecting base 16. The second terminal group 224 and the first terminal group 167 are electrically connected to each other to form an electrical path. A user could check the electrical path formed by the electrical connection between the second terminal group 224 and the first terminal group 167 to determine whether the impeller driver 20 is at a state of connecting to the centrifugal pump 10.

The other end of the driver casing 22 facing away from the connecting base 16 has a base plate 225. A peripheral edge of the base plate 225 is connected to an end edge of the other end of the casing portion 221 facing away from the connecting base 16. A positioning base 226 is formed on a middle on an inner surface of the base plate 225. The positioning base 226 has an insertion groove 2261. The insertion groove 2261 is a conical groove, and the central axis L passes through a center of the insertion groove 2261. The insertion groove 2261 is sleeved on the guiding post 163 for positioning, so that the connecting portion 222 and the connecting base 16 could be accurately aligned. A stator seat 227 is formed on the casing portion 221. The stator seat 227 is a circular tube and is connected to the base plate 225. The central axis L passes through a center of the stator seat 227. An end of the stator seat 227 facing the connecting base 16 extends out of the casing portion 221 and extends into the annular groove 164 of the connecting base 16. A side of the base plate 225 facing away from the connecting base 16 is engaged with an end base 228. In the current embodiment, the end base 228 is a rectangular casing with a space provided therein.

The stator 24 includes a plurality of stator modules 241. Each of the stator modules 241 includes an iron core and a coil surrounding the iron core. The stator modules 241 surround the stator seat 227, are spaced from one another, and are engaged with an inside of the stator seat 227. An end of each of the stator modules 241 facing the connecting base 16 extends to abut against the annular groove 164. The central axis L passes through a center of an area surrounded by the stator modules 241. The extending cylinder 162 is accommodated between the stator modules 241. The second terminal group 224 is electrically connected to the coils of the stator modules 241, so that the coils of the stator modules 241 are electrically connected to the circuit board 18 through the first terminal group 167.

In order to drive the stator modules 241 of the stator 24 to generate a magnetic field, a driving circuit could be disposed in the driver casing 22. Through the driving circuit electrically connected to the coils of the stator modules 241, the stator modules 241 are driven to generate an alternating driving magnetic field. In other embodiments, the driving circuit could be changed to be disposed on the circuit board 18 of the centrifugal pump 10; alternatively, the driving circuit could be disposed on an external device to which the circuit board 18 is electrically connected; in this way, the stator modules 241 of the stator 24 could be controlled by the driving circuit disposed on the circuit board 18 or the external device to generate the driving magnetic field.

The impeller 14 is spaced apart and located outside an end of the stator modules 241 along the central axis L, and the impeller 14 is disposed at a position where the impeller 14 could be affected by the driving magnetic field generated by the stator modules 241, so that the impeller 14 could be driven by the driving magnetic field to rotate around the central axis L and pressurize the liquid input from the inlet S2 to the cavity S and then output the liquid through the outlet S3. The handle 26 is engaged with the other end of the driver casing 22 facing away from the connecting base 16. More specifically, the handle 26 is engaged with a side of the end base 228 facing away from the connecting base 16. The handle 26 is for the user to hold and pull the impeller driver 20 out of the connecting base 16 of the centrifugal pump 10. In other embodiments, the handle 26 could be omitted; in such case, the user could directly hold the driver casing 22 to pull the impeller driver 20 out of the connecting base 16 of the centrifugal pump 10.

Referring to FIG. 3 and FIG. 8 to FIG. 10, when the mechanically-electrically separated pump 100 according to the embodiment of the present disclosure is used, the mechanically-electrically separated pump 100 is connected in series to a liquid pipeline of a liquid-cooling heat dissipation system. More specifically, two connectors of two ends of the liquid pipeline are respectively connected to the inlet S2 and the outlet S3 of the centrifugal pump 10. Cooling liquid is input from the inlet S2 to the cavity S of the centrifugal pump 10. Then, the stator modules 241 of the stator 24 of the impeller driver 20 generate the alternating driving magnetic field, so that the impeller 14 located in the cavity S of the centrifugal pump 10 is driven to rotate. Through a centrifugal force generated by the rotation of the impeller 14, the cooling liquid input from the inlet S2 is pressurized and is output from the outlet S3 to the liquid pipeline for continuous circulation.

With the aforementioned design, the connecting base 16 of the centrifugal pump 10 and the connecting portion 222 of the impeller driver 20 are detachable from each other. The stator 24 including the iron cores and the coils is disposed on the stator seat 227 of the impeller driver 20, so that when the user needs to inspect the stator 24 that generates the driving magnetic field, the user could hold the handle 26 and pull the impeller driver 20 out of the connecting base 16 of the centrifugal pump 10, thereby detaching the impeller driver 20 from the connecting base 16 of the centrifugal pump 10 for subsequent maintenance. During the aforementioned process, as the centrifugal pump 10 remains at a state of connecting to the liquid pipeline of the liquid-cooling heat dissipation system, the connectors of the liquid pipeline are not required to be disconnected, and the cooling liquid in the liquid pipeline is not required to be discharged. In this way, maintenance of the impeller driver 20 could be performed easily and conveniently and damage to electronic devices due to leakage of the cooling liquid could be prevented, so that maintenance of the liquid-cooling heat dissipation system could be performed easily and rapidly.

Moreover, the hollowed holes 126 of the axial portion 125 of the mechanically-electrically separated pump 100 facilitate the cooling liquid to smoothly pass through the inlet S2 and enter the cavity S. The guiding post 163 of the connecting base 16 of the centrifugal pump 10 and the insertion groove 2261 of the impeller driver 20 match each other through conical structures, thereby ensuring that the impeller driver 20 and the connecting base 16 of the centrifugal pump 10 are coaxially aligned along the central axis L during assembling. Furthermore, through the recess 166 of the centrifugal pump 10 cooperating with the protruding sheet 223 of the impeller driver 20, the orientation and stability of the impeller driver 20 detachably connected to the connecting base 16 could be ensured. Through checking whether the first terminal group 167 of the centrifugal pump 10 and the second terminal group 224 of the impeller driver 20 are electrically connected to form the circuit, whether the impeller driver 20 is connected to the centrifugal pump 10 could be determined, so that the driving circuit and controlling circuits thereof disposed on the mechanically-electrically separated pump 100 or outside the mechanically-electrically separated pump 100 could accordingly determine whether the mechanically-electrically separated pump 100 is at an assembled state or a detached state and control the stator 24 of the impeller driver 20 to drive the centrifugal pump 10 to operate.

It must be pointed out that the embodiments described above are only some preferred embodiments of the present disclosure. All equivalent structures which employ the concepts disclosed in this specification and the appended claims should fall within the scope of the present disclosure.

What is claimed is:

1. A mechanically-electrically separated pump, comprising:

a centrifugal pump, having a central axis and comprising a pump casing, an impeller, and a connecting base, wherein a cavity is formed in the pump casing; an inlet and an outlet are respectively formed on the pump casing; the inlet and the outlet respectively communicate with a center of the cavity and a peripheral side of the cavity; an axial portion extends in a middle of the cavity; the central axis passes through a center of the axial portion; a center of the impeller has an axial hole and a periphery of the impeller has a plurality of blades; the impeller is sleeved on the axial portion via the axial hole; the impeller is magnetized or induced to generate a plurality of different magnetic domains; the connecting base is connected to a side of the pump casing along the central axis; and an impeller driver, comprising a driver casing and a stator, wherein a connecting portion is formed at an end of the driver casing; the connecting portion is detachably connected to the connecting base of the centrifugal pump; a stator seat is defined by the driver casing; the stator comprises a plurality of stator modules; the plurality of stator modules extend circumferentially along the stator seat, are spaced from one another, and are engaged with the stator seat; the central axis passes through the center of the impeller and a center of an area surrounded by the plurality of stator modules; the impeller is spaced apart and located outside an end of the plurality of stator modules along the central axis, so that the impeller is driven by a magnetic field generated by the plurality of stator modules.

2. The mechanically-electrically separated pump as claimed in claim 1, wherein the connecting base comprises a covering plate; the covering plate is connected to a side of the pump casing along the central axis; an extending cylinder extends from a middle of the covering plate along a direction away from the pump casing; the extending cylinder is inward of the plurality of stator modules; a guiding post is connected to an end of the extending cylinder facing away from the pump casing; a base plate is provided on an other end of the driver casing facing away from the connecting base; a positioning base is formed on an inner surface of the base plate; the positioning base has an insertion groove; the positioning base is sleeved on the guiding post via the insertion groove.

3. The mechanically-electrically separated pump as claimed in claim 2, wherein an annular groove is formed on a surface of the covering plate facing away from the pump casing; the annular groove surrounds the extending cylinder; a frame portion is formed on a portion of the covering plate located outward of the annular groove; the frame portion has a recess; the driver casing has a casing portion; an end surface of an end of the casing portion facing the connecting base forms the connecting portion; the connecting portion abuts against the frame portion and has a protruding sheet; the protruding sheet is fitted into the recess for positioning; a peripheral edge of the base plate is connected to an end edge of an end of the casing portion facing away from the connecting base; the stator seat is a circular tube and is connected to the base plate; an end of the stator seat facing the connecting base extends out of the casing portion and extends into the annular groove; an end of each of the plurality of stator modules facing the connecting base extends to abut against the annular groove.

4. The mechanically-electrically separated pump as claimed in claim 3, wherein a first terminal group is disposed on the frame portion; a second terminal group is disposed on the connecting portion; the second terminal group is electrically connected to the plurality of stator modules of the stator; the second terminal group and the first terminal group are electrically connected to form an electrical path.

5. The mechanically-electrically separated pump as claimed in claim 4, wherein a plate seat is formed around the pump casing; the plate seat is engaged with a circuit board; the circuit board and the first terminal group are electrically connected, so that the stator and the circuit board are electrically connected.

6. The mechanically-electrically separated pump as claimed in claim 5, wherein four locking holes are respectively formed on four corners of a periphery of the plate seat; a mounting groove is formed on a side of the plate seat; the circuit board is mounted in the mounting groove.

7. The mechanically-electrically separated pump as claimed in claim 5, wherein an end of the circuit board facing away from the impeller driver has a plurality of electronic contacts; a socket is provided on a side of the circuit board.

8. The mechanically-electrically separated pump as claimed in claim 1, wherein the pump casing has a cover; the cavity is formed inside the cover and the cover has an opening communicating with the cavity; a center of the cover is connected to an inlet pipe; the inlet is formed on an outer end of the inlet pipe; the axial portion is formed by extending from a peripheral edge of an inner end of the inlet pipe toward the cavity and has a plurality of hollowed holes; a side of a periphery of the cover is connected to an outlet pipe; the outlet pipe is parallel to the central axis; the outlet is formed on an outer end of the outlet pipe; the connecting base comprises a covering plate; the covering plate is engaged with a peripheral edge of the opening through screwing; the covering plate closes the opening of the cover in a sealed manner.

9. The mechanically-electrically separated pump as claimed in claim 8, wherein an extending cylinder extends from a middle of the covering plate along a direction away from the pump casing; the extending cylinder is inward of the plurality of stator modules; a guiding post is connected to an end of the extending cylinder facing away from the pump casing; a base plate is provided at an other end of the driver casing facing away from the connecting base; the stator seat is connected to the base plate; a positioning base is formed on an inner surface of the base plate; the positioning base has an insertion groove; the positioning base is sleeved on the guiding post via the insertion groove.

10. The mechanically-electrically separated pump as claimed in claim 1, wherein an other end of the driver casing facing away from the connecting base has an end base; the end base is engaged with a handle.

* * * * *